US008920126B2

(12) United States Patent
Iida

(10) Patent No.: US 8,920,126 B2
(45) Date of Patent: Dec. 30, 2014

(54) TURBINE AND TURBINE ROTOR BLADE

(75) Inventor: Koichiro Iida, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 425 days.

(21) Appl. No.: 13/387,310

(22) PCT Filed: Dec. 7, 2009

(86) PCT No.: PCT/JP2009/070466
§ 371 (c)(1),
(2), (4) Date: Jan. 26, 2012

(87) PCT Pub. No.: WO2011/070636
PCT Pub. Date: Jun. 16, 2011

(65) Prior Publication Data

US 2012/0121394 A1 May 17, 2012

(51) Int. Cl.
*F01D 5/22* (2006.01)
*F01D 11/08* (2006.01)
*F01D 5/14* (2006.01)

(52) U.S. Cl.
CPC ..... *F01D 11/08* (2013.01); *F05D 2250/314* (2013.01); *F01D 5/143* (2013.01); *F01D 5/225* (2013.01)
USPC ..... 416/189; 415/173.6; 415/220

(58) Field of Classification Search
CPC ..... F01D 5/225
USPC ..... 415/173.6, 220; 416/189, 190, 195
See application file for complete search history.

(56) References Cited

U.S. PATENT DOCUMENTS 5,064,343 A 11/1991 Mills
5,238,364 A * 8/1993 Kreitmeier ..... 415/173.1
(Continued)

FOREIGN PATENT DOCUMENTS

JP 7-233703 A 9/1995
JP 10-8910 A 1/1998
(Continued)

OTHER PUBLICATIONS

Decision to Grant dated Jun. 4, 2013, issued in corresponding Japanese application No. 2008-151928, with English Translation.
(Continued)

*Primary Examiner* — Ninh H Nguyen
(74) *Attorney, Agent, or Firm* — Westerman, Hattori, Daniels & Adrian, LLP

(57) ABSTRACT

An object is to provide a turbine and a turbine rotor blade in which it is possible to ensure the strength of the turbine rotor blade and to improve the performance thereof. The turbine includes: rotor blades that rotate about a rotational axis in a main flow channel of a casing; stator vanes that are disposed in the casing; a tip shroud that is disposed at a radially-outward end of each of the rotor blades and whose length in the direction along the rotational axis is reduced as the distance from the rotor blade increases; and a cavity portion that is formed at a position in the casing facing the rotor blades and in which the tip shroud is accommodated. An inclination angle of the inner periphery of the tip shroud is larger than an average inclination angle that is an inclination angle of the inner periphery of the casing, averaged from the trailing edge of the stator vanes disposed at the upstream side of a main flow to the cavity portion disposed at the downstream side of the main flow.

6 Claims, 11 Drawing Sheets

(56) References Cited

U.S. PATENT DOCUMENTS

| | | | | |
|---|---|---|---|---|
| 6,129,513 | A | 10/2000 | Halliwell et al. | |
| 6,579,066 | B1 * | 6/2003 | Saito et al. | 416/243 |
| 6,736,596 | B2 * | 5/2004 | Ito et al. | 415/173.1 |
| 6,913,445 | B1 | 7/2005 | Beddard et al. | |
| 6,916,021 | B2 | 7/2005 | Beeck et al. | |
| 7,063,509 | B2 * | 6/2006 | Snook et al. | 416/189 |
| 2005/0129519 | A1 | 6/2005 | Beddard et al. | |
| 2005/0169761 | A1 | 8/2005 | Dube et al. | |

FOREIGN PATENT DOCUMENTS

| | | | |
|---|---|---|---|
| JP | 11-229805 | A | 8/1999 |
| JP | 2002-129901 | A | 5/2002 |
| JP | 2002-371802 | A | 12/2002 |
| JP | 2003-106107 | A | 4/2003 |
| JP | 2004-332736 | A | 11/2004 |
| JP | 2005-61414 | A | 3/2005 |
| JP | 2005-214207 | A | 8/2005 |
| JP | 2005-273489 | A | 10/2005 |
| JP | 2006-233857 | A | 9/2006 |
| JP | 2009-47043 | A | 3/2009 |
| JP | 2009-133312 | A | 6/2009 |

OTHER PUBLICATIONS

Japanese Office Action dated Oct. 2, 2012, issued in corresponding Japanese Patent Application No. 2008-151928, with English translation (11 pages).

Chinese Office Action dated Dec. 4, 2013, issued in corresponding Chinese Patent Application No. 200980160732.4 with English translation (16 pages).

Korean Decision to Grant a Patent dated Apr. 18, 2014, issued in corresponding Korean Patent Application No. 10-2013-7016497 (3 pages), "The Decision to Grant a Patent has been received".

Porreca et al., "Optimized shroud design for axial turbine aerodynamic performance", Turbomachinery Laboratory, Swiss Federal Institute of Technology ETH Zürich, Proceedings of GT2007, ASME Turbo Expo 2007: Power for Land, Sea and Air, May 14-17, 2007, Montreal, Canada, pp. 1-13.

International Search Report of PCT/JP2009/070466, mailing date of Mar. 16, 2010.

Korean Decision to Grant a Patent dated Aug. 26, 2013, issued in corresponding Korean Patent Application No. 10-2012-7001317.

Office Action dated Aug. 13, 2014, issued in corresponding Chinese Patent Application No. 200980160732.4, with English Translation (13 pages).

* cited by examiner

TURBINE AND TURBINE ROTOR BLADE

TECHNICAL FIELD

The present invention relates to a turbine and a turbine rotor blade, and particularly, to a turbine and a turbine rotor blade suitable for use in a gas turbine or a steam turbine.

BACKGROUND ART

In general, there are known turbine rotor blades having shrouds (tip shrouds) at the blade ends thereof, which are used for a gas turbine or the like. When a vibration occurs in the turbine rotor blades, the shrouds of adjacent turbine rotor blades abut against each other, thereby suppressing the vibration.

The above-described shrouds of the turbine rotor blades have been reduced in weight in terms of strength.

In particular, while turbine rotor blades have been increased in length and height due to a recent increase in turbine capacity caused by an increase in turbine output, the shrouds of turbine rotor blades that are disposed at the downstream side of a gas flow in the gas turbine, for example, turbine rotor blades that are disposed at a third stage or a fourth stage in the turbine, have been reduced in weight in order to reduce the centrifugal load as much as possible because, during rotation, a larger centrifugal load is imposed on those turbine rotor blades than on other turbine rotor blades that are disposed at the upstream side.

Furthermore, it is difficult to ensure the strength of the turbine rotor blades because the temperature of working fluid flowing around the turbine rotor blades has been increased in order to increase the turbine output, and, therefore, a reduction in the weight of the shrouds is achieved in order to reduce the strength required for the turbine rotor blades as much as possible.

Specifically, a partial-cover shape for covering only part of the space between blade portions of the turbine rotor blades is adopted as the shape of each shroud, thereby achieving a reduction in the weight of the shroud (NPL 1).

CITATION LIST

Non Patent Literature

{NPL 1} L. Porreca, A. I. Kalfas, R. S. Abhari, "OPTIMIZED SHROUD DESIGN FOR AXIAL TURBINE AERODYNAMIC PERFORMANCE", Proceedings of GT2007, ASME Turbo Expo 2007: Power for Land, Sea and Air, May 14-17, 2007, Montreal, Canada, GT2007-27915

SUMMARY OF INVENTION

Technical Problem

However, when the partial-cover shape is adopted for the shroud as described above, there are problems in that the performances of the turbine rotor blades and the turbine may be reduced, as described in NPL 1, compared with turbine rotor blades having a full-cover-shaped shroud that covers the entire space between the blade portions of the turbine rotor blades.

FIG. 12 is a schematic view of a partial-cover-shaped shroud, seen from a radially outward side. FIG. 13 is a schematic view for explaining working fluid flowing around turbine rotor blades having the partial-cover-shaped shroud shown in FIG. 12.

With reference to FIG. 13, a description will be given of the working fluid flowing around turbine rotor blades 504 when a tip shroud 542 has, for example, a shape concaved in the direction of the working fluid flowing between the turbine rotor blades 504 (the vertical direction in FIG. 12), as shown in FIG. 12.

FIG. 13 is a schematic view for explaining the working fluid flowing along a dotted line in FIG. 12. In other words, FIG. 13 schematically explains the working fluid flowing on the dorsal side of a rotor blade 541 (the convex side of the curved rotor blade 541) of each of the turbine rotor blades 504.

As shown in FIG. 13, a cavity portion 532 that is formed in a concave shape is formed at a position of a casing 503 facing the turbine rotor blades 504. A plate-like seal fin 543 that extends radially outward and extends in the rotational direction of the turbine rotor blades 504 (the direction perpendicular to the plane of FIG. 13) is provided at a radially outward (upper in FIG. 13) end portion of each of the turbine rotor blades 504.

As shown in FIG. 13, part of the working fluid flowing in the casing 503 toward the turbine rotor blades 504 collides with a concave-shaped portion of the tip shroud 542. The working fluid that has collided with the concave-shaped portion separates from the tip shroud 542 to form a separation vortex V when returning to the casing 503 again.

There are problems in that, when the separation vortex V is formed, a flow loss of the working fluid occurs, reducing the performance of the turbine rotor blades 504.

The present invention has been made to solve the above-described problems, and an object thereof is to provide a turbine and a turbine rotor blade capable of ensuring the strength of the turbine rotor blade and of improving the performance thereof.

Solution to Problem

In order to achieve the above-described object, the present invention provides the following solutions.

According to one aspect, the present invention provides a turbine including: rotor blades that rotate about a rotational axis in a main flow channel of an approximately-cylindrical-shaped casing whose diameter is increased toward a downstream side; stator vanes that are disposed in the casing at a distance from the rotor blades in the direction of the rotational axis; a tip shroud that is disposed at a radially-outward end of each of the rotor blades to constitute part of an annular-shaped shroud and whose length in a direction along the rotational axis is reduced as the distance from the rotor blade increases; and a cavity portion that is formed in a concave shape at a position in the casing facing the rotor blades and in which the tip shroud is accommodated, in which an inclination angle $\theta b$ of an inner periphery of the tip shroud with respect to the rotational axis is larger than an average inclination angle $\theta a$ that is an inclination angle of an inner periphery of the casing with respect to the rotational axis, averaged from a trailing edge of the stator vanes disposed at an upstream side of a main flow to the cavity portion disposed at a downstream side of the main flow.

According to the turbine of the aspect of the present invention, the inclination angle $\theta b$ of the inner periphery of the tip shroud is larger than the average inclination angle $\theta a$ of the inner periphery of the casing. Therefore, it is possible to avoid a collision between the main flow flowing in the casing and the tip shroud and to improve the performance of the turbine rotor blade, which has the rotor blade and the tip shroud, and the performance of the turbine.

Specifically, the main flow flowing along the inner periphery of the casing in a direction substantially having the average inclination angle θa with respect to the rotational axis flows in a direction substantially having the average inclination angle θb in a region where the rotor blade and the shroud are disposed. On the other hand, since the inclination angle θb of the inner periphery of the shroud is larger than the average inclination angle θa, the distance between the inner periphery of the shroud and the above-described main flow is increased toward the downstream side of the main flow.

Thus, the distance to the above-described main flow is larger at a portion of the tip shroud away from the rotor blade than at a portion of the tip shroud close to the rotor blade. As a result, the above-described collision is unlikely to occur at the portion of the tip shroud away from the rotor blade, which is likely to collide with the above-described main flow, that is, at a portion of the tip shroud that is concave toward the downstream side of the main flow. In other words, it is possible to avoid the occurrence of turbulence in the main flow caused by a collision with the tip shroud and to improve the performance of the turbine rotor blade, which has the rotor blade and the tip shroud, and the performance of the turbine.

On the other hand, because the tip shroud has a partial-cover shape in which the length of the tip shroud in the direction along the rotational axis is reduced as the distance from the rotor blade increases, the mass of the tip shroud can be reduced, compared with a tip shroud having a full-cover shape.

Thus, it is possible to suppress an increase in centrifugal load imposed on the rotor blade during the operation of the turbine and to ensure the strength of the turbine rotor blade, which has the rotor blade and the tip shroud.

In the above-described turbine according to the aspect of the present invention, it is preferable that the inclination angle θb of the inner periphery of the tip shroud be larger than the average inclination angle θa of the inner periphery of the casing by 5 degrees or more.

According to this structure, the inclination angle θb of the inner periphery of the tip shroud is set to be larger than the average inclination angle θa of the inner periphery of the casing by 5 degrees or more, and, thus, it is possible to more reliably avoid a collision between the main flow flowing in the casing and the tip shroud and to improve the performance of the turbine rotor blade, which has the rotor blade and the tip shroud, and the performance of the turbine.

In one of the above-described turbines according to the aspect of the present invention, it is preferable that a distance dx1 corresponding to the distance in the direction along the rotational axis from an end of the tip shroud at the upstream side of the main flow to an end of the cavity portion at the upstream side thereof and a chord length dx2 of the rotor blade in the direction along the rotational axis at the radially-outward end of the rotor blade satisfy a relational expression $dx1<0.5\times dx2$.

According to this structure, the distance dx1 is set to be shorter than half of the chord length dx2, and thus, it is possible to more reliably avoid a collision between the main flow flowing in the casing and the tip shroud and to improve the performance of the turbine rotor blade, which has the rotor blade and the tip shroud, and the performance of the turbine.

Specifically, when the distance dx1 is set short, as described above, the main flow flowing in the casing is unlikely to flow into the space between the cavity portion and the tip shroud, and the above-described collision is unlikely to occur at a portion of the tip shroud that is concave toward the downstream side of the main flow.

Note that it is preferable that the relationship between the distance dx1 and the chord length dx2 satisfy the formula $0.3\times dx2<dx1<0.5\times dx2$, and furthermore, the relationship therebetween satisfy the formula $dx1=0.45\times dx2$.

The present invention provides a turbine rotor blade including: a rotor blade that rotates about a rotational axis in a main flow channel of a casing; and a tip shroud that is disposed at a radially-outward end of the rotor blade to constitute part of an annular-shaped shroud and whose length in a direction along the rotational axis is reduced as the distance from the rotor blade increases, in which a portion of the inner periphery of the tip shroud at a convex side of the rotor blade is located farther outward in the radial direction than a portion of the inner periphery of the tip shroud at a concave side of the rotor blade.

According to the present invention, when the portion of the inner periphery of the tip shroud at the convex side of the rotor blade is located farther outward in the radial direction than the portion thereof at the concave side of the rotor blade, it is possible to avoid a collision between the main flow flowing in the casing and the portion of the tip shroud at the convex side of the rotor blade and to improve the performance of the turbine rotor blade, which has the rotor blade and the tip shroud, and the performance of the turbine.

Specifically, compared with the main flow flowing on the concave side of the rotor blade, the main flow flowing on the convex side of the rotor blade is more likely to flow into the space between the cavity portion and the tip shroud and is more likely to collide with the tip shroud. Thus, as described above, the portion of the inner periphery of the tip shroud at the convex side of the rotor blade is located radially outward away from the main flow, thereby making it possible to avoid a collision between the main flow and the portion of the tip shroud at the convex side of the rotor blade.

On the other hand, because the tip shroud has the partial-cover shape in which the length of the tip shroud in the direction along the rotational axis is reduced as the distance from the rotor blade increases, the mass of the tip shroud can be reduced, compared with a tip shroud having a full-cover shape.

Thus, it is possible to suppress an increase in centrifugal load imposed on the rotor blade during the rotation of the turbine rotor blade and to ensure the strength of the turbine rotor blade, which has the rotor blade and the tip shroud.

In the above-described turbine rotor blade according to the aspect of the present invention, it is preferable that the tip shroud extend radially outward from the concave side to the convex side of the rotor blade, in the vicinity of the rotor blade.

According to this structure, since the portion of the tip shroud at the convex side of the rotor blade is inclined radially outward as the distance from the rotor blade increases, a collision between the main flow flowing in the casing and the portion of the tip shroud at the convex side of the rotor blade is avoided. In other words, since the portion of the tip shroud at the convex side of the rotor blade is farther away from the main flow than the portion thereof at the concave side is, a collision between the main flow flowing in the casing and the portion of the tip shroud at the convex side of the rotor blade is avoided.

In the above-described turbine rotor blade according to the aspect of the present invention, it is preferable that the curvature of the shape of a fillet that connects a portion of the rotor blade at the convex side to the tip shroud be smaller than the curvature of the shape of a fillet that connects a portion of the rotor blade at the concave side to the tip shroud.

According to this structure, the curvature of the fillet shape of the convex-side portion of the rotor blade is set to be smaller than the curvature of the fillet shape of the concave-side portion of the rotor blade, and thus, in the vicinity of the rotor blade, the portion of the inner periphery of the tip shroud at the convex side of the rotor blade is located farther outward in the radial direction than the portion thereof at the concave side of the rotor blade. Thus, it is possible to avoid a collision between the main flow flowing in the casing and the portion of the tip shroud at the convex side of the rotor blade.

Advantageous Effects of Invention

According to the turbine of the present invention, an advantage is afforded in that, since the inclination angle θb of the inner periphery of the tip shroud is larger than the average inclination angle θa of the inner periphery of the casing, it is possible to avoid a collision between the main flow flowing in the casing and the tip shroud and to improve the performance of the turbine rotor blade, which has the rotor blade and the tip shroud, and the performance of the turbine.

Furthermore, an advantage is afforded in that, since the tip shroud has a partial-cover shape in which the length of the tip shroud in the direction along the rotational axis is reduced as the distance from the rotor blade increases, it is possible to suppress an increase in centrifugal load imposed on the rotor blade during the operation of the turbine and to ensure the strength of the turbine rotor blade, which has the rotor blade and the tip shroud.

According to the turbine rotor blade of the present invention, an advantage is afforded in that, since the portion of the inner periphery of the tip shroud at the convex side of the rotor blade is located farther outward in the radial direction than the portion thereof at the concave side of the rotor blade, it is possible to avoid a collision between the main flow flowing in the casing and the portion of the tip shroud at the convex side of the rotor blade and to improve the performance of the turbine rotor blade, which has the rotor blade and the tip shroud, and the performance of the turbine.

An advantage is afforded in that, since the tip shroud has a partial-cover shape in which the length of the tip shroud in the direction along the rotational axis is reduced as the distance from the rotor blade increases, it is possible to suppress an increase in centrifugal load imposed on the rotor blade during the rotation of the turbine rotor blade and to ensure the strength of the turbine rotor blade, which has the rotor blade and the tip shroud.

DESCRIPTION OF EMBODIMENTS

First Embodiment

A turbine 1 according to a first embodiment of the present invention will be described below with reference to FIGS. 1 to 3.

Figure 1:
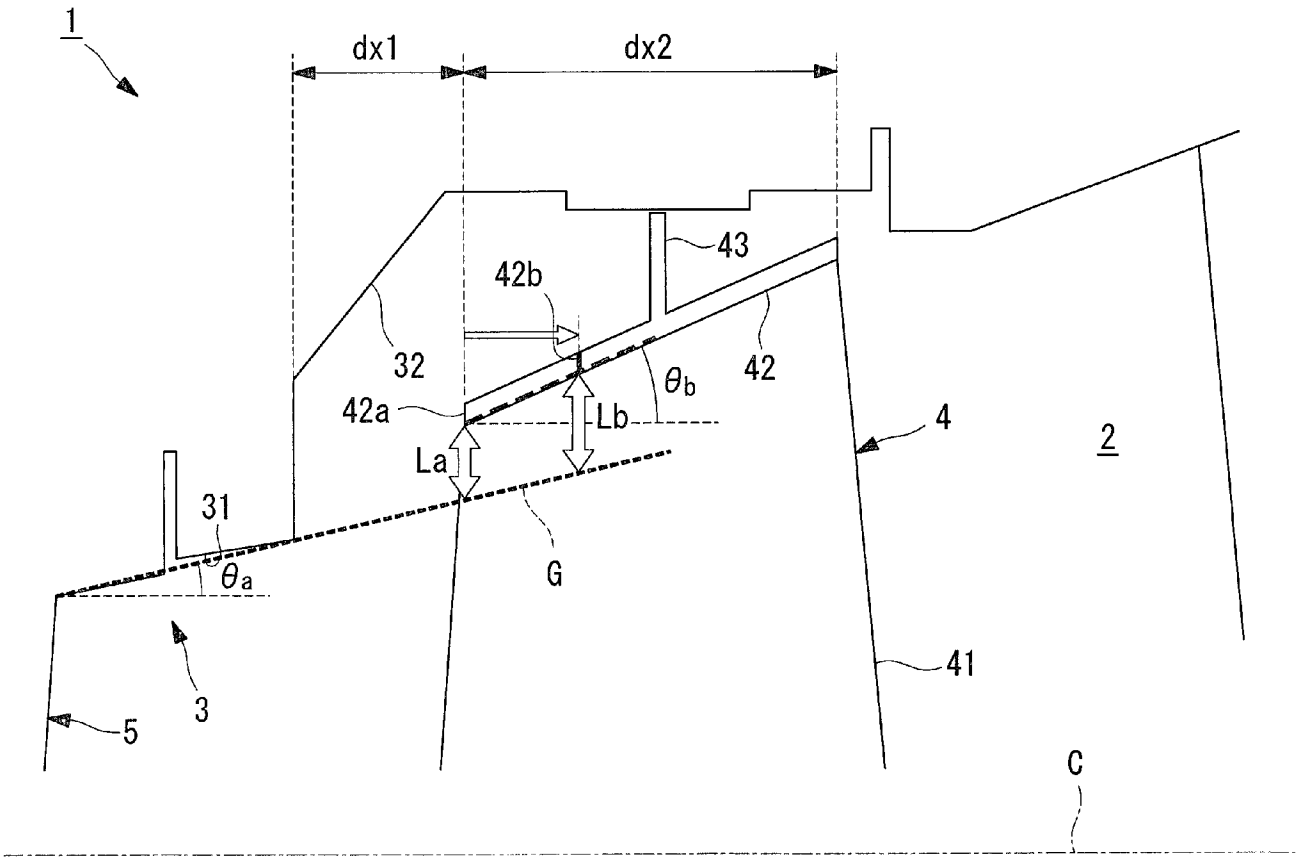
FIG. 1 is a schematic view for explaining the structure of a turbine according to a first embodiment of the present invention.

FIG. 1 is a schematic view for explaining the structure of the turbine of this embodiment.

As shown in FIG. 1, the turbine 1 is provided with a casing 3 in which a main flow channel 2 is formed, through which high-temperature fluid, such as combustion gas, flows; turbine rotor blades 4 that are disposed so as to be capable of rotating about a rotational axis C together with a rotary shaft (not shown); and turbine stator vanes 5 that are attached to the casing 3.

The turbine rotor blades 4 and the turbine stator vanes 5 shown in FIG. 1 are third-stage rotor blades and third-stage stator vanes that are disposed at the third stage from the upstream side of a main flow in the turbine 1.

Note that, in this embodiment, a description will be given of a case where the invention of this application is used in the vicinity of the turbine rotor blades 4 and the turbine stator vanes 5; however, the position is not limited to the vicinity of the third-stage rotor blades and the third-stage stator vanes. The invention of this application may be used in the vicinity of fourth-stage rotor blades and fourth-stage stator vanes, and the position is not particularly limited.

The casing 3 is formed in an approximately cylindrical shape in which the main flow channel 2, the turbine rotor blades 4, and the turbine stator vanes 5 are disposed.

As shown in FIG. 1, the inner periphery of a region in the casing 3 where the turbine rotor blades 4 and the turbine stator vanes 5 are disposed is formed at a slant radially outward from the rotational axis C from the upstream side to the downstream side (from the left side to the right side in FIG. 1).

Furthermore, the casing 3 is provided with a segmented ring 31 and a cavity portion 32.

The segmented ring 31 is disposed between the turbine rotor blades 4 and the turbine stator vanes 5, constitutes part of the casing 3, and is formed in a suitable annular shape around the rotational axis C.

The cavity portion 32 is formed on the inner periphery of the casing 3 facing the turbine rotor blades 4, in a concave shape radially outward from the rotational axis C. In other words, the cavity portion 32 is an annular-shaped groove portion formed on the inner periphery of the casing 3.

On the inner periphery of the casing 3 next to the cavity portion 32, the turbine stator vanes 5 are arranged at substantially regular intervals along the cavity portion 32 and are disposed so as to extend radially inward.

Note that a compressor that compresses outside air, a combustor that mixes fuel with the compressed air for combustion, or the like may be disposed closer to the upstream side (left side in FIG. 1) than the region in the casing 3 where the turbine rotor blades 4 and the turbine stator vanes 5 are disposed, but there are no particular limitations.

Each of the turbine rotor blades 4 is provided with a rotor blade 41 that is a blade portion extending along the radial direction, a tip shroud 42 that is disposed at a blade end of the rotor blade 41, and a seal fin 43 that is disposed on an outer periphery of the tip shroud 42.

Figure 2:
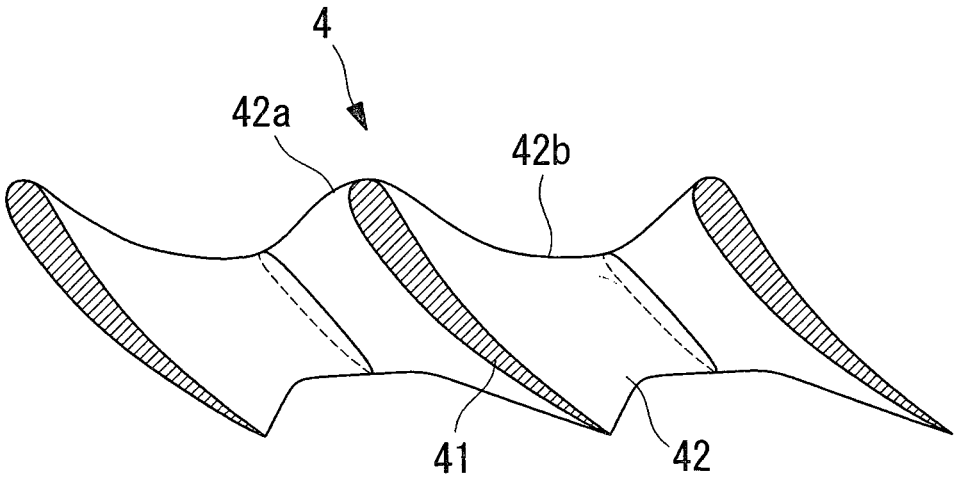
FIG. 2 is a schematic view for explaining the shapes of a tip shroud, a seal fin, etc. of a turbine rotor blade shown in FIG. 1.

FIG. 2 is a schematic view for explaining the shapes of the tip shroud, the seal fin, etc. of the turbine rotor blade shown in FIG. 1.

As shown in FIGS. 1 and 2, the rotor blade 41 is a rotor that extends outward along the radial direction and that is supported so as to be capable of rotating about the rotational axis C.

The rotor blade 41 is a plate-like member formed in an airfoil shape in cross section. In this embodiment, the side at a face curved in a convex shape (the left side in FIG. 2) of the rotor blade 41 is referred to as a dorsal side (convex side), and the side at a face curved in a concave shape (the right side in FIG. 2) thereof is referred to as a ventral side (concave side).

As shown in FIGS. 1 and 2, the tip shroud 42 constitutes an annular-shaped shroud around the rotational axis C, together with tip shrouds 42 provided for the other turbine rotor blades 4.

As shown in FIG. 2, when seen from a radially outward side, the tip shroud 42 has a shape in which the width corresponding to the size in a direction along the rotational axis C (the vertical direction in FIG. 2), in other words, in a direction along the main flow, is largest in the vicinity of the rotor blade 41 and is reduced as the distance from the rotor blade 41 increases along the circumferential direction (the horizontal direction in FIG. 2).

Furthermore, the tip shroud 42 abuts against an adjacent tip shroud 42 at a portion where the width thereof is reduced.

The seal fin 43 is used to narrow the space between the tip shroud 42 of the rotor blade and the cavity portion 32 to form a tip clearance, thereby preventing a bypass flow from flowing.

Specifically, the seal fin 43 is a ring-plate-like member extending radially outward from the outer periphery of the tip shroud 42.

Here, a description will be given of the relationship between an average inclination angle θa of the inner periphery of the casing 3 and an inclination angle θb of the inner periphery of the tip shroud 42, which is a feature of this embodiment.

As shown in FIG. 1, the average inclination angle θa of the inner periphery of the casing 3 is formed by the rotational axis C and an average inclination line G that connects the inner periphery of the turbine stator vanes 5 at the trailing edge and the inner periphery of the segmented ring 31 at a wake end portion. On the other hand, the inclination angle θb of the inner periphery of the tip shroud 42 is formed by the rotational axis C and the inner periphery of the tip shroud 42.

The above-described average inclination angle θa and inclination angle θb satisfy at least Formula (1).

$$\theta a<\theta b \tag{1}$$

Furthermore, it is more preferable to satisfy the relationship of Formula (2).

$$\theta b-\theta a>5^\circ \tag{2}$$

In other words, a distance Lb between an upstream end 42*b* of the tip shroud 42 away from the rotor blade 41 and the above-described average inclination line G is set to be longer than a distance La between an upstream end 42*a* of the tip shroud 42 close to the rotor blade 41 and the above-described average inclination line G.

In other words, the upstream end 42*a* is located farther outward in the radial direction than the above-described average inclination line G, and the upstream end 42*b* is located farther outward in the radial direction than the upstream end 42*a*.

Next, a description will be given of the relationship between a distance dx1 between the turbine rotor blade 4 and the cavity portion 32 and a chord length dx2 of the turbine rotor blade 4.

The distance dx1 is obtained by measuring, along the rotational axis C, the distance between the upstream end 42*a* of the tip shroud 42 and the upstream end of the cavity portion 32, in other words, the distance between the upstream end 42*a* and a downstream end of the segmented ring 31.

The chord length dx2 is the length of the rotor blade 41 along the rotational axis C, at a radially-outward end thereof.

The above-described distance dx1 and chord length dx2 satisfy at least Formula (3).

$$dx1<0.5\times dx2 \tag{3}$$

Furthermore, it is preferable to satisfy the relationship of Formula (4).

$$0.3\times dx2<dx1<0.5\times dx2 \tag{4}$$

It is more preferable to satisfy the relationship of Formula (5).

$$dx1=0.45\times dx2 \tag{5}$$

Next, the flow of high-temperature fluid in the thus-structured turbine 1 will be described.

As shown in FIG. 1, the high-temperature fluid flowing in the main flow channel 2 of the turbine 1 passes between the turbine stator vanes 5 and then flows toward the turbine rotor blades 4 located at the downstream side, along the inner periphery of the casing 3. In other words, the high-temperature fluid flows downstream while expanding the sectional flow-channel area according to the average inclination angle θa of the inner periphery of the casing 3.

Figure 3:
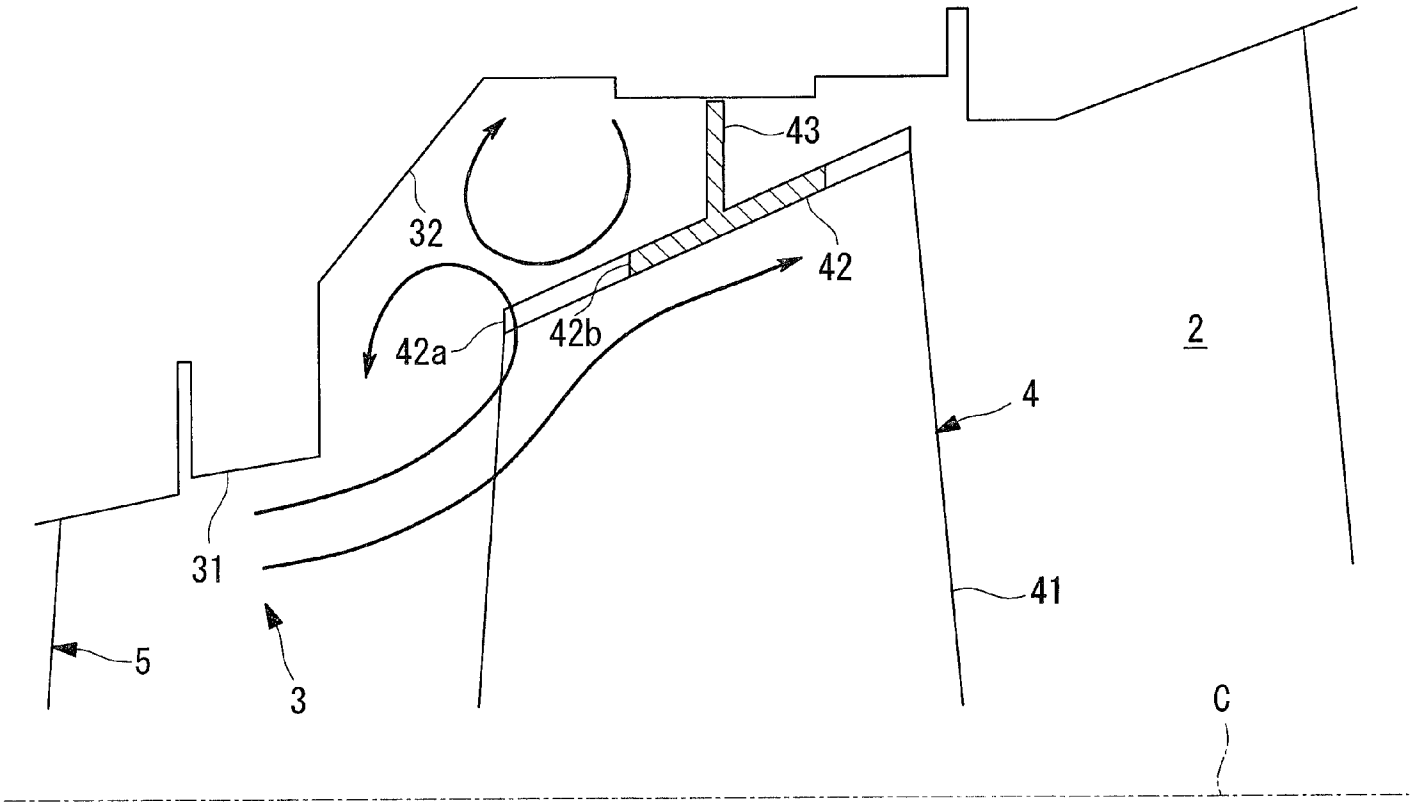
FIG. 3 is a schematic view for explaining the flow of high-temperature fluid around the turbine rotor blade shown in FIG. 1.

FIG. 3 is a schematic view for explaining the flow of high-temperature fluid around the turbine rotor blade shown in FIG. 1.

As shown in FIG. 3, part of the high-temperature fluid flowing from the segmented ring 31 to the cavity portion 32 flows into the cavity portion 32 from the space between the upstream end 42*b* of the tip shroud 42 and the segmented ring 31 to form a circulating flow. On the other hand, the rest of the high-temperature fluid flows downstream along the inner periphery of the tip shroud 42.

Even at the upstream end 42*a* of the tip shroud 42, the high-temperature fluid flows downstream without colliding with the tip shroud 42 because the tip shroud 42 is disposed inside the cavity portion 32, in other words, is disposed farther outward in the radial direction than the inner periphery of the segmented ring 31.

According to the above-described structure, since the inclination angle θb of the inner periphery of the tip shroud 42 is larger than the average inclination angle θa of the inner periphery of the casing 3, it is possible to avoid a collision between the high-temperature fluid flowing in the casing 3 and the tip shroud 42 and to improve the performance of the turbine rotor blade 4, which has the rotor blade 41 and the tip shroud 42, and the performance of the turbine 1.

Specifically, the main flow flowing along the inner periphery of the casing 3 in a direction substantially having the average inclination angle θa with respect to the rotational axis C flows in a direction substantially having the average inclination angle θb in a region where the turbine rotor blades 4 are disposed. On the other hand, since the inclination angle θb of the inner periphery of the tip shroud 42 is larger than the average inclination angle θa, the distance between the inner periphery of the tip shroud 42 and the above-described main flow is increased toward the downstream side of the flow of high-temperature fluid.

Thus, the distance to the above-described main flow is larger at a portion of the tip shroud away from the rotor blade 41 than at a portion of the tip shroud close to the rotor blade 41. As a result, the above-described collision is unlikely to occur at the portion of the tip shroud 42 away from the rotor blade 41, which is likely to collide with the above-described main flow, that is, at the upstream end 42*b*. In other words, it is possible to avoid the occurrence of turbulence in the main flow caused by a collision with the tip shroud 42 and to improve the performance of the turbine rotor blade 4 and the performance of the turbine 1.

On the other hand, since the tip shroud 42 has the partial-cover shape, in which the length of the tip shroud 42 in the direction along the rotational axis C is reduced as the distance from the rotor blade 41 increases, the mass of the tip shroud 42 can be reduced, compared with a tip shroud having a full-cover shape.

Thus, it is possible to suppress an increase in centrifugal load imposed on the rotor blade 41 during the operation of the turbine 1 and to ensure the strength of the turbine rotor blade 4.

When the inclination angle θb of the inner periphery of the tip shroud 42 is set to be larger than the average inclination angle θa of the inner periphery of the casing 3 by 5 degrees or more, it is possible to more reliably avoid a collision between the high-temperature fluid flowing in the casing 3 and the tip shroud 42 and to improve the performance of the turbine rotor blade 4 and the performance of the turbine 1.

When the distance dx1 is set to be shorter than half of the chord length dx2, it is possible to more reliably avoid a collision between the high-temperature fluid flowing in the casing 3 and the tip shroud 42 and to improve the performance of the turbine rotor blade 4, which has the rotor blade and the tip shroud, and the performance of the turbine 1.

Specifically, when the distance dx1 is set short, as described above, the high-temperature fluid flowing in the casing 3 is unlikely to flow into the space between the cavity portion 32 and the tip shroud 42, and the above-described collision is unlikely to occur at a portion of the tip shroud 42 that is concave toward the downstream side of the main flow.

Second Embodiment

Next, a second embodiment of the present invention will be described with reference to FIGS. 4 to 9.

Although the basic structure of a turbine of this embodiment is the same as that of the first embodiment, this embodiment differs from the first embodiment in the shape of a tip shroud of a turbine rotor blade. Therefore, in this embodiment, only the vicinity of the turbine rotor blade will be described using FIGS. 4 to 9, and a description of the other components will be omitted.

Figure 4:
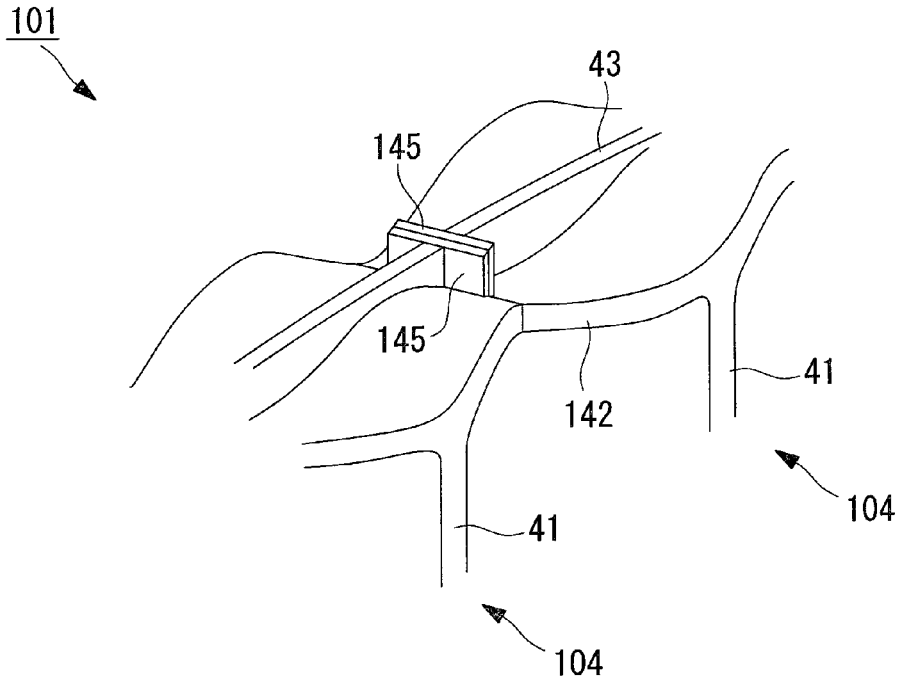
FIG. 4 is a schematic view for explaining the shape of a turbine rotor blade of a turbine according to a second embodiment of the present invention.

FIG. 4 is a schematic view for explaining the shape of the turbine rotor blade of the turbine of this embodiment.

Note that identical reference symbols are assigned to the same components as those of the first embodiment, and a description thereof will be omitted.

As shown in FIG. 4, each turbine rotor blade 104 of a turbine 101 of this embodiment is provided with a rotor blade 41 that is a blade portion extending along the radial direction, a tip shroud 142 that is disposed at a blade end of the rotor blade 41, and a seal fin 43 and a contact rib 145 that are disposed on the outer periphery of the tip shroud 142.

Figure 5:
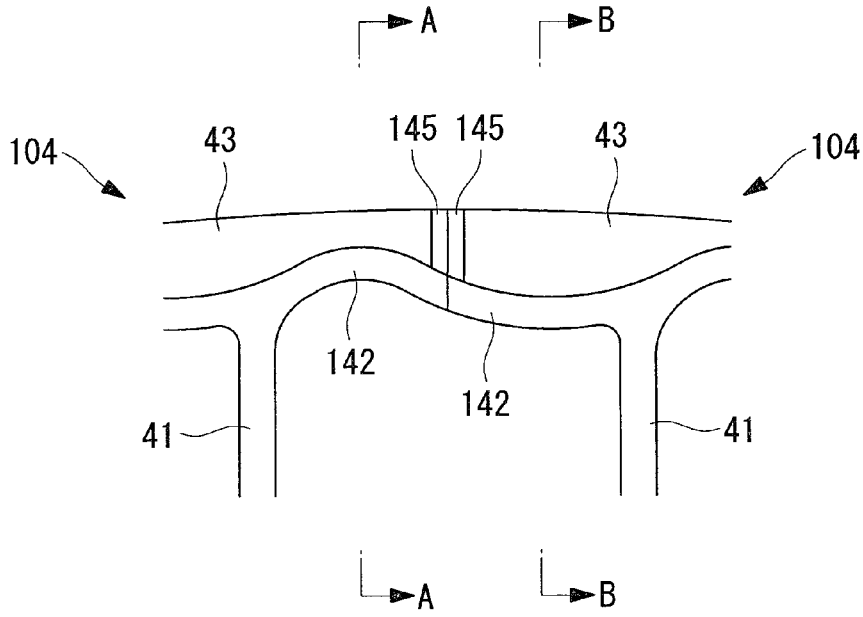
FIG. 5 is a view for explaining the shape of a tip shroud shown in FIG. 4, seen from an upstream side of the flow of high-temperature fluid.
Figure 6:
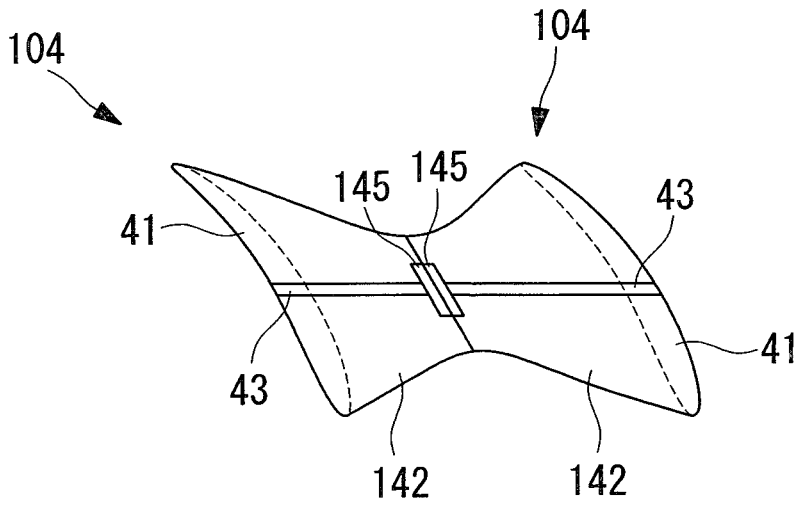
FIG. 6 is a view for explaining the shape of the tip shroud shown in FIG. 4, seen from a radially outward side.

FIG. 5 is a view for explaining the shape of the tip shroud shown in FIG. 4, seen from the upstream side of the flow of high-temperature fluid. FIG. 6 is a view for explaining the shape of the tip shroud shown in FIG. 4, seen from a radially outward side.

As shown in FIGS. 4 and 5, the tip shroud 142 constitutes an annular-shaped shroud around the rotational axis C, together with tip shrouds 142 provided for the other turbine rotor blades 104.

As shown in FIG. 4, when seen from the upstream side of the flow of high-temperature fluid, the tip shroud 142 is inclined radially outward (upward in FIG. 5) in the vicinity of the rotor blade 41 from the ventral side to the dorsal side (from the left side to the right side in FIG. 5) of the rotor blade 41.

On the other hand, at an end of the tip shroud 142 away from the rotor blade 41, the tip shroud 142 is inclined in the opposite direction to that in the vicinity of the rotor blade 41, so as to form a smooth inner periphery together with an adjacent tip shroud 142.

With the tip shroud 142 being structured in this way, the inner periphery of the tip shroud 142 in the vicinity of the dorsal side (the right side in FIG. 5) of the rotor blade 41 is located farther outward in the radial direction than the inner periphery of the tip shroud 142 in the vicinity of the ventral side (the left side in FIG. 5) of the rotor blade 41.

As shown in FIG. 6, when seen from the radially outward side, the tip shroud 142 has a shape in which the width corresponding to the size in a direction along the rotational axis C (the vertical direction in FIG. 6), in other words, in a direction along the main flow, is largest in the vicinity of the rotor blade 41 and is reduced as the distance from the rotor blade 41 increases along the circumferential direction (the horizontal direction in FIG. 6).

Furthermore, the tip shroud 142 abuts against an adjacent tip shroud 142 at a portion where the width thereof is reduced.

The contact rib 145 is a plate-like member provided at the end of the tip shroud 142 where the tip shroud 142 is brought into contact with the adjacent tip shroud 142. The contact rib 145 extends radially outward from the outer periphery of the tip shroud 142 and extends along the rotational axis C.

With this structure, the contact rib 145 is brought into surface contact with an adjacent contact rib 145.

Next, a description will be given of the flow of high-temperature fluid in the thus-structured turbine 101.

First, the flow of high-temperature fluid on the dorsal side of the rotor blade 41 of the turbine rotor blade 104 will be described, and then, the flow of high-temperature fluid on the ventral side of the rotor blade 41 will be described.

Figure 7:
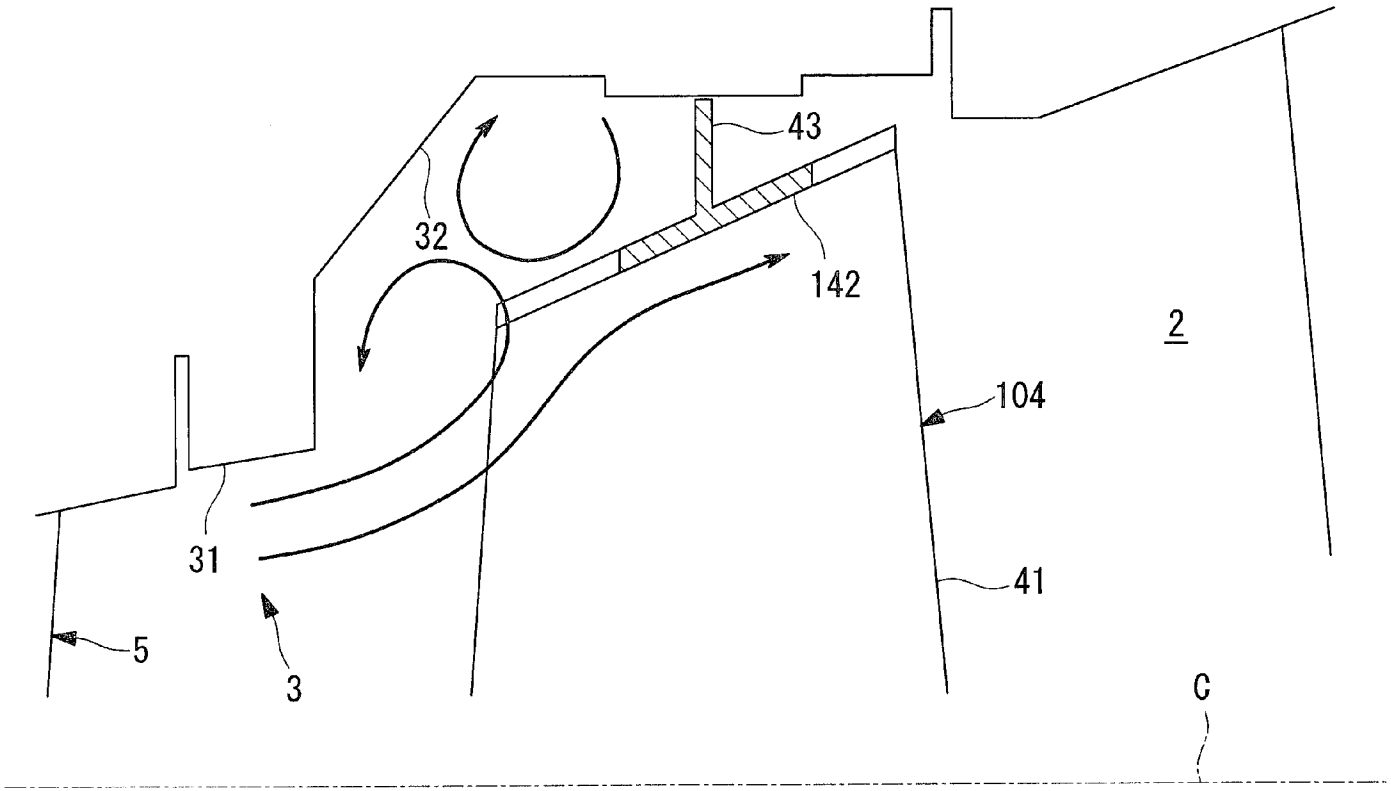
FIG. 7 is a cross-sectional view along line A-A for explaining the flow of high-temperature fluid on a dorsal side of the turbine rotor blade shown in FIG. 5.

FIG. 7 is a cross-sectional view along line A-A for explaining the flow of high-temperature fluid on the dorsal side of the turbine rotor blade shown in FIG. 5.

In the vicinity of the dorsal side of the rotor blade 41 of the turbine rotor blade 104, the high-temperature fluid flows as shown in FIG. 7. Specifically, since the portion of the tip shroud 142 in the vicinity of the dorsal side of the rotor blade 41 is located radially outward, in other words, away from the flow of high-temperature fluid, compared with the portion of the tip shroud 142 in the vicinity of the ventral side of the rotor blade 41, the high-temperature fluid flowing from the region of the segmented ring 31 to the region of the turbine rotor blade 104 smoothly flows downstream, without colliding with the tip shroud 142.

Figure 8:
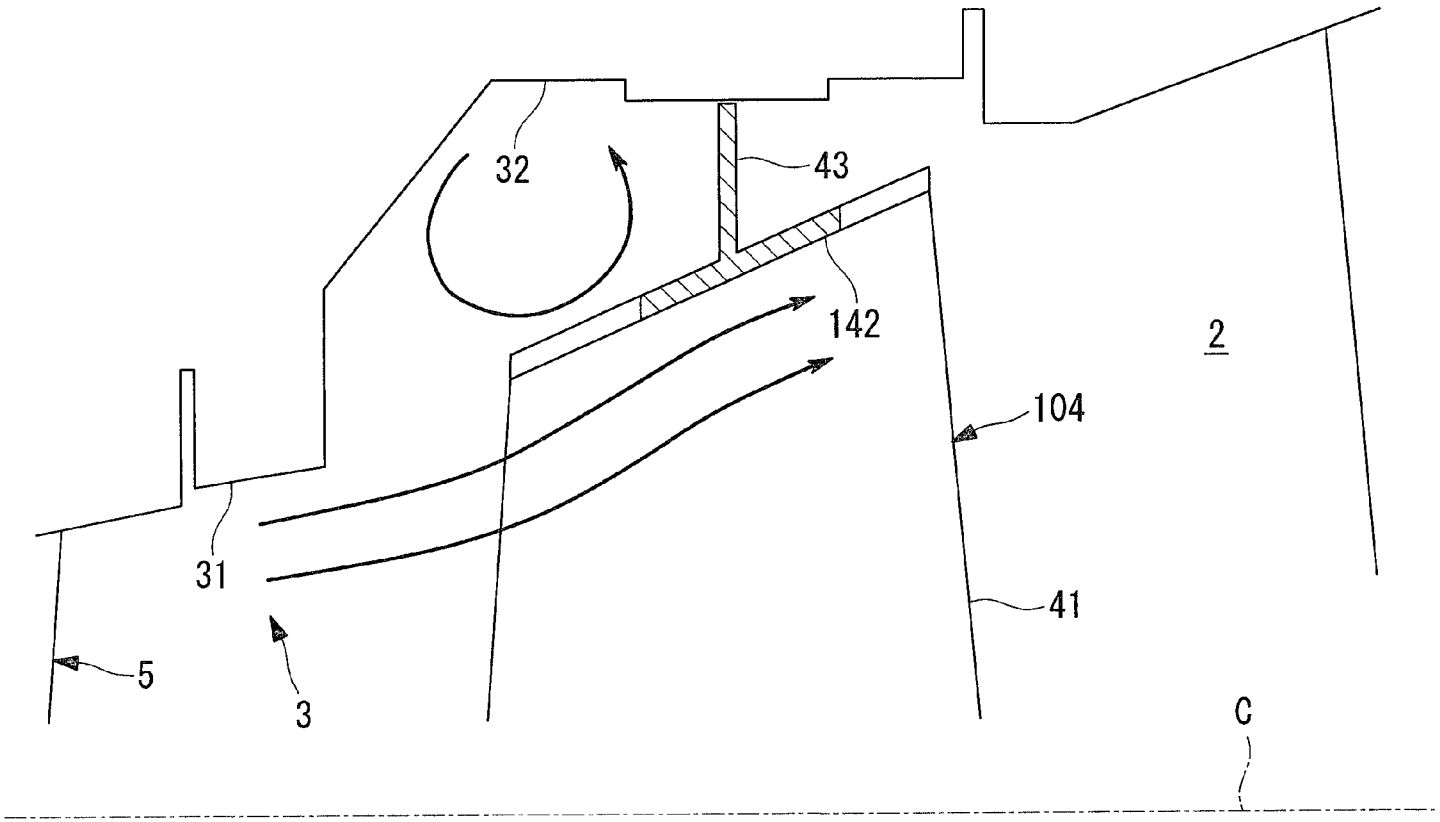
FIG. 8 is a cross-sectional view along line B-B for explaining the flow of high-temperature fluid on a ventral side of the turbine rotor blade shown in FIG. 5.

FIG. 8 is a cross-sectional view along line B-B for explaining the flow of high-temperature fluid on the ventral side of the turbine rotor blade shown in FIG. 5.

In the vicinity of the ventral side of the rotor blade 41 of the turbine rotor blade 104, the high-temperature fluid flows as shown in FIG. 8. Specifically, since the portion of the tip shroud 142 in the vicinity of the ventral side of the rotor blade 41 is located radially inward, in other words, close to the flow of high-temperature fluid, compared with the portion of the tip shroud 142 in the vicinity of the dorsal side of the rotor blade 41, the high-temperature fluid flowing from the region of the segmented ring 31 to the region of the turbine rotor blade 104 smoothly flows downstream, without forming a strong circulating flow (see FIG. 9) in the cavity portion 32.

Figure 9:
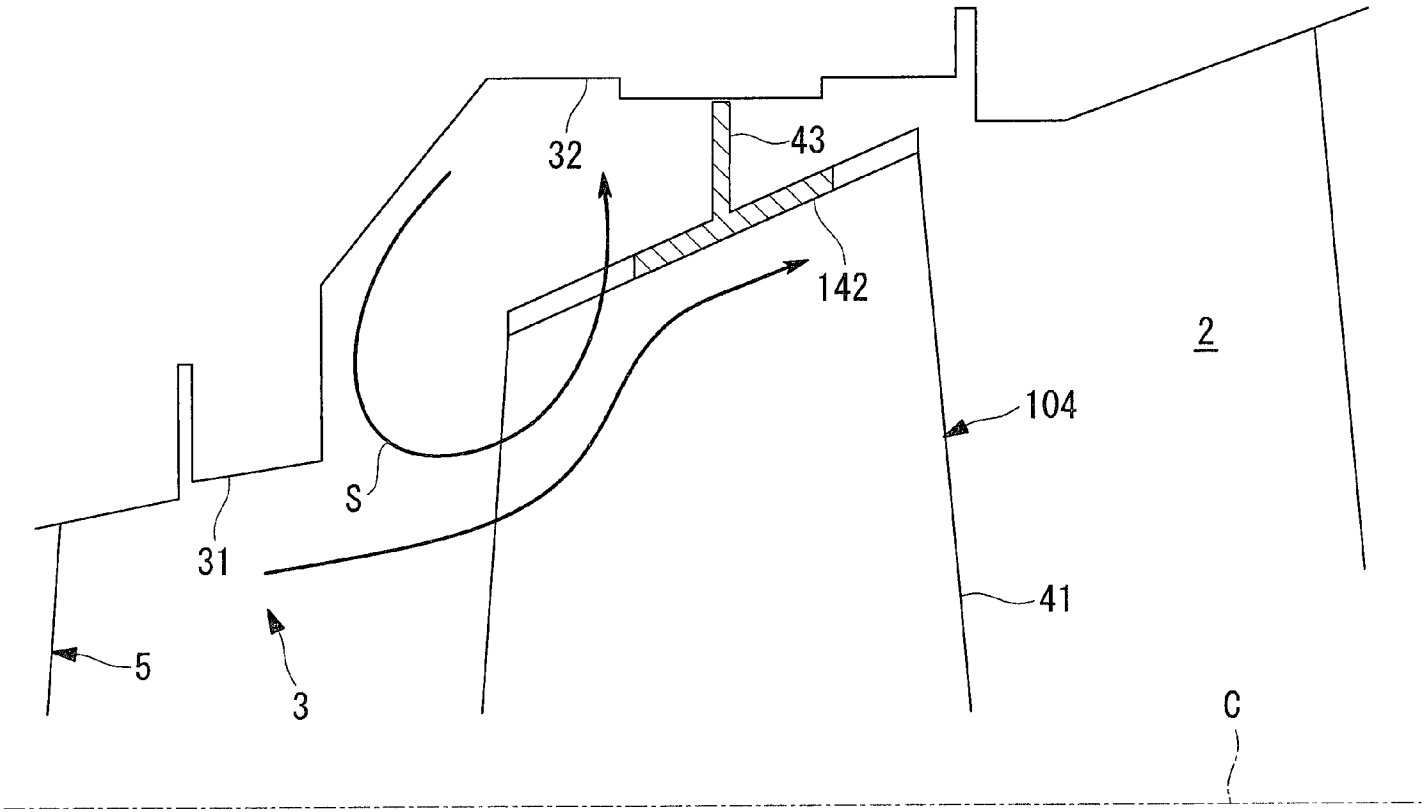
FIG. 9 is a schematic view for explaining the flow of high-temperature fluid when a strong circulating flow is formed at the ventral side of the turbine rotor blade.

FIG. 9 is a schematic view for explaining the flow of high-temperature fluid when a strong circulating flow is formed at the ventral side of the turbine rotor blade.

If the portion of the tip shroud 142 in the vicinity of the ventral side of the rotor blade 41 is located radially outward and away from the flow of high-temperature fluid, as in the portion of the tip shroud 142 in the vicinity of the dorsal side of the rotor blade 41, a strong circulating flow S is formed inside the cavity portion 32, in other words, between the segmented ring 31 and the turbine rotor blade 104, as shown in FIG. 9. Due to the circulating flow S, the flow of high-temperature fluid is turned around, and the performance of the turbine rotor blade 104 is reduced.

The high-temperature fluid flows at a higher speed in the vicinity of the dorsal side of the rotor blade 41 than in the vicinity of the ventral side thereof. Thus, even if the portion of the tip shroud 142 in the vicinity of the dorsal side of the rotor blade 41 is located radially outward, the high-temperature fluid smoothly flows downstream therearound, without forming a strong circulating flow, unlike in the vicinity of the ventral side.

On the other hand, even if the portion of the tip shroud 142 in the vicinity of the ventral side of the rotor blade 41 is located radially inward, the high-temperature fluid smoothly flows downstream therearound, without colliding with the tip shroud 142, unlike in the vicinity of the dorsal side.

According to the above-described structure, when the portion of the tip shroud 142 at the dorsal side of the rotor blade 41 is located farther outward in the radial direction than the portion of the tip shroud 142 at the ventral side of the rotor blade 41, it is possible to prevent the high-temperature fluid flowing in the casing 3 from colliding with the portion of the tip shroud 142 at the dorsal side of the rotor blade 41 and to improve the performance of the turbine rotor blade 104 and the performance of the turbine 101.

Specifically, the high-temperature fluid flowing on the dorsal side of the rotor blade 41 is more likely to flow into the space between the cavity portion 32 and the tip shroud 142 and is more likely to collide with the tip shroud 142, compared with the high-temperature fluid flowing on the ventral side of the rotor blade 41. Thus, as described above, the portion of the tip shroud 142 at the dorsal side of the rotor blade is located radially outward away from the high-temperature fluid, thereby making it possible to prevent the flow of high-temperature fluid from colliding with the portion of the tip shroud 142 at the dorsal side of the rotor blade.

Third Embodiment

Next, a third embodiment of the present invention will be described with reference to FIGS. 10 and 11.

Although the basic structure of a turbine of this embodiment is the same as that of the first embodiment, this embodiment differs from the first embodiment in the shape of a tip shroud of a turbine rotor blade. Therefore, in this embodiment, only the vicinity of the turbine rotor blade will be described using FIGS. 10 and 11, and a description of the other components will be omitted.

Figure 10:
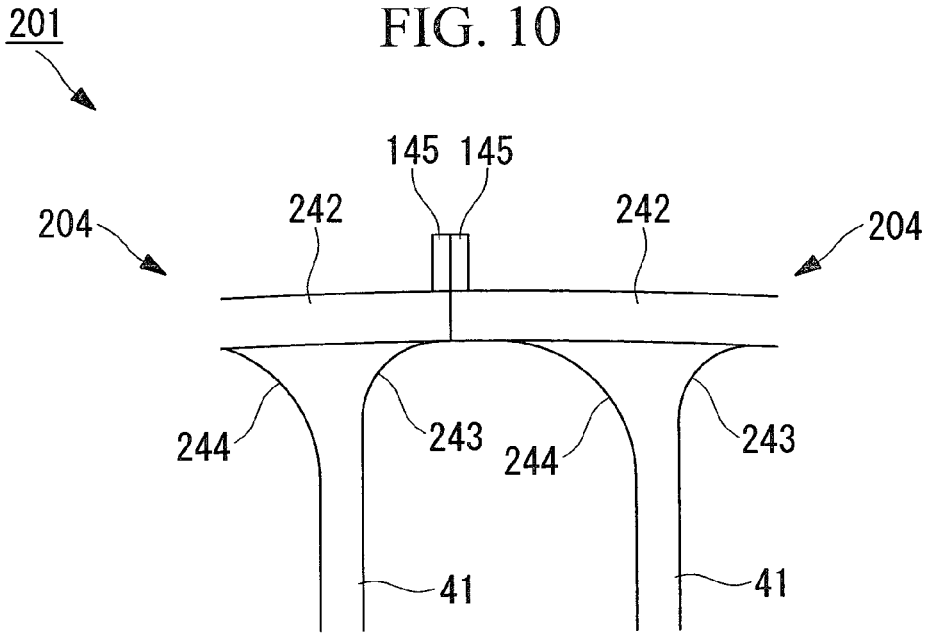
FIG. 10 is a schematic view for explaining the shape of a turbine rotor blade of a turbine according to the third embodiment.

FIG. 10 is a schematic view for explaining the shape of the turbine rotor blade of the turbine of this embodiment. FIG. 11 is a view for explaining the shape of the tip shroud shown in FIG. 10, seen from a radially outward side.

Note that identical reference symbols are assigned to the same components as those of the first embodiment, and a description thereof will be omitted.

Figure 11:
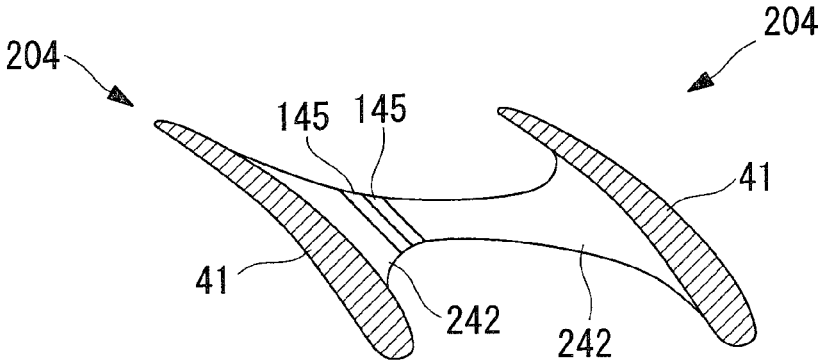
FIG. 11 is a view for explaining the shape of a tip shroud shown in FIG. 10, seen from a radially outward side.
Figure 12:
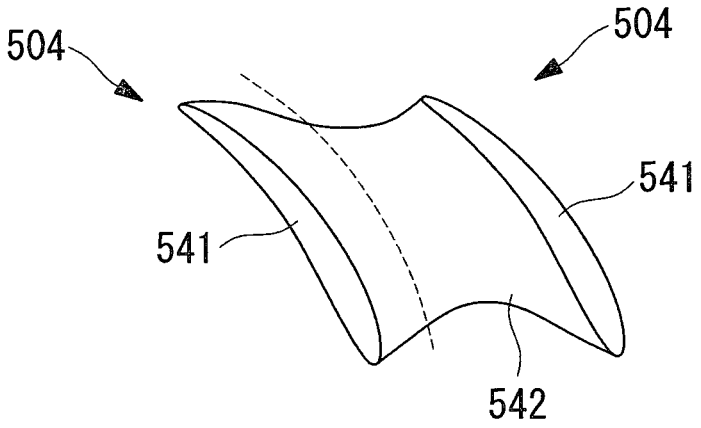
FIG. 12 is a schematic view of a partial-cover-shaped shroud, seen from a radially outward side.
Figure 13:
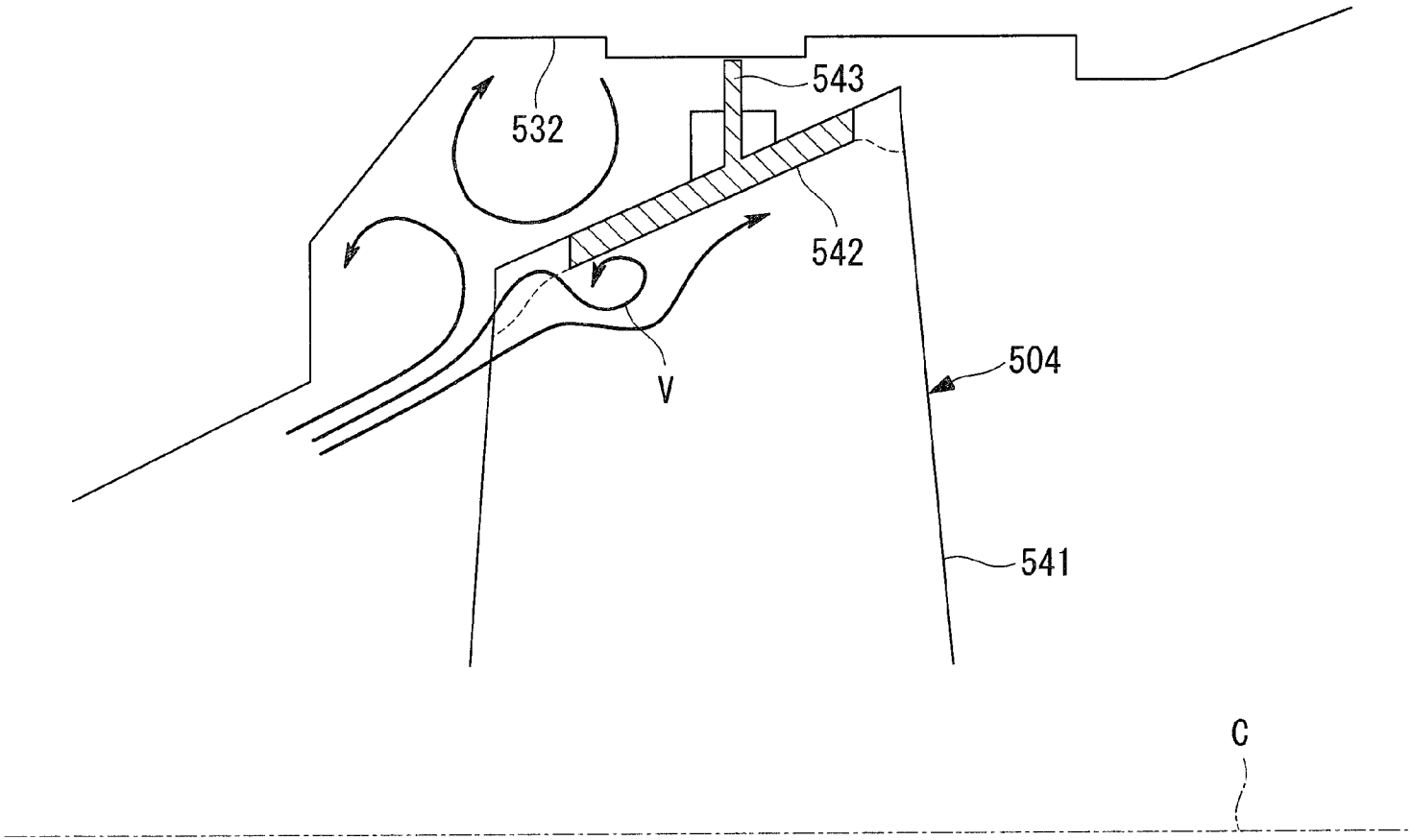
FIG. 13 is a schematic view for explaining the flow of working fluid around a turbine rotor blade having the partial-cover-shaped shroud shown in FIG. 12.

As shown in FIGS. 10 and 11, a turbine rotor blade 204 of a turbine 201 of this embodiment is provided with the rotor blade 41 that is a blade portion extending along the radial direction, a tip shroud 242 that is disposed at a blade end of the rotor blade 41, and the seal fin 43 and the contact rib 145 that are disposed on the outer periphery of the tip shroud 242.

The tip shroud 242 constitutes an annular-shaped shroud around the rotational axis C, together with tip shrouds 242 provided for the other turbine rotor blades 204.

A dorsal-side surface of the rotor blade 41 (the right-side surface thereof in FIG. 10) is smoothly connected to the inner periphery of the tip shroud 242 with a dorsal-side fillet 243. On the other hand, a ventral-side surface of the rotor blade 41 (the left-side surface thereof in FIG. 10) is smoothly connected to the inner periphery of the tip shroud 242 with a ventral-side fillet 244.

The dorsal-side fillet 243 has a smaller radius of curvature than the ventral-side fillet 244. Thus, in the vicinity of the rotor blade 41, the dorsal-side fillet 243 is located farther outward in the radial direction than the ventral-side fillet 244.

In other words, the ventral-side fillet 244 has a larger radius of curvature than the dorsal-side fillet 243. Thus, in the vicinity of the rotor blade 41, the inner periphery of the tip shroud 242 close to the ventral side of the rotor blade 41 is located farther inward in the radial direction than (lower in FIG. 10) than the inner periphery of the tip shroud 242 close to the dorsal side.

As shown in FIG. 11, when seen from a radially outward side, the tip shroud 242 has a shape in which the width corresponding to the size in a direction along the rotational axis C (the vertical direction in FIG. 11), in other words, in a direction along the main flow, is largest in the vicinity of the rotor blade 41 and is reduced as the distance from the rotor blade 41 increases along the circumferential direction (the horizontal direction in FIG. 11).

Furthermore, the tip shroud 242 abuts against an adjacent tip shroud 42 at a portion where the width thereof is reduced. The end of the tip shroud 242 abutting against the adjacent tip shroud 242 is disposed at a position close to the dorsal-side surface of the rotor blade 41 and away from the ventral-side surface thereof, as shown in FIG. 11.

Since the flow of high-temperature fluid in the turbine 201, having the above-described structure, is the same as that in the second embodiment, a description thereof will be omitted.

According to the above-described structure, the radius of curvature of the dorsal-side fillet 243 is set to be smaller than the radius of curvature of the ventral-side fillet 244, and thus, in the vicinity of the rotor blade 41, a portion of the inner periphery of the tip shroud 242 at the dorsal side of the rotor blade 41 is located farther outward in the radial direction than a portion of the inner periphery of the tip shroud 242 at the ventral side of the rotor blade 41. Thus, it is possible to avoid a collision between the high-temperature fluid flowing in the casing 3 and the portion of the tip shroud 242 at the dorsal side of the rotor blade 41.

Note that the technical scope of the present invention is not limited to the above-described embodiments, and various changes can be added without departing from the spirit of the present invention.

For example, in the above-described embodiments, a description has been given of a case where this invention is applied to the turbine rotor blade of the gas turbine; however, this invention is not limited to the turbine rotor blade of the gas turbine but can be applied to a turbine rotor blade of various turbines, such as a steam turbine.

REFERENCE SIGNS LIST

1, 101, 201 turbine
2 main flow channel
4, 104, 204 turbine rotor blade
5 turbine stator vane
32 cavity portion
41 rotor blade
42, 142, 242 tip shroud
θa average inclination angle
θb inclination angle
C rotational axis

The invention claimed is:

1. A turbine comprising:

rotor blades that rotate about a rotational axis in a main flow channel of an approximately-cylindrical-shaped casing whose diameter is increased toward a downstream side;

stator vanes that are disposed in the casing at a distance from the rotor blades in the direction of the rotational axis;

a tip shroud that is disposed at a radially-outward end of each of the rotor blades to constitute part of an annular-shaped shroud and whose length in a direction along the rotational axis is reduced as the distance from the rotor blade increases; and a cavity portion that is formed in a concave shape at a position in the casing facing the rotor blades and in which the tip shroud is accommodated, wherein an inclination angle θb of an inner periphery of the tip shroud with respect to the rotational axis is larger than an average inclination angle θa that is an inclination angle of an inner periphery of the casing with respect to the rotational axis, averaged from a trailing edge of the stator vanes disposed at an upstream side of a main flow to the cavity portion disposed at a downstream side of the main flow.

2. A turbine according to claim 1, wherein the inclination angle θb of the inner periphery of the tip shroud is larger than the average inclination angle θa of the inner periphery of the casing by 5 degrees or more.

3. A turbine according to claim 1, wherein a distance dx1 corresponding to the distance in the direction along the rotational axis from an end of the tip shroud at the upstream side of the main flow to an end of the cavity portion at the upstream side thereof and a chord length dx2 of the rotor blade in the direction along the rotational axis at the radially-outward end of the rotor blade satisfy a relational expression $dx1<0.5\times dx2$.

4. A turbine rotor blade comprising:

a rotor blade that rotates about a rotational axis in a main flow channel of a casing; and a tip shroud that is disposed at a radially-outward end of the rotor blade to constitute part of an annular-shaped shroud and whose length in a direction along the rotational axis is reduced as the distance from the rotor blade increases, wherein a portion of the inner periphery of the tip shroud at a convex side of the rotor blade is located farther outward in the radial direction than a portion of the inner periphery of the tip shroud at a concave side of the rotor blade.

5. A turbine rotor blade according to claim 4, wherein the tip shroud extends radially outward from the concave side to the convex side of the rotor blade, in the vicinity of the rotor blade.

6. A turbine rotor blade according to claim 4, wherein the curvature of the shape of a fillet that connects a portion of the rotor blade at the convex side to the tip shroud is smaller than the curvature of the shape of a fillet that connects a portion of the rotor blade at the concave side to the tip shroud.

* * * * *